US010781639B1

(12) United States Patent
Egbe

(10) Patent No.: US 10,781,639 B1
(45) Date of Patent: Sep. 22, 2020

(54) SELF-ADJUSTING DOWNHOLE MOTOR

(71) Applicant: Saudi Arabian Oil Company, Dhahran (SA)

(72) Inventor: Peter Ido Egbe, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/366,745

(22) Filed: Mar. 27, 2019

(51) Int. Cl.

| | |
|---|---|
| ***E21B 7/06*** | (2006.01) |
| ***E21B 4/02*** | (2006.01) |
| ***E21B 7/04*** | (2006.01) |
| ***E21B 7/10*** | (2006.01) |

(52) U.S. Cl.
CPC ..... *E21B 7/067* (2013.01); *E21B 4/02* (2013.01); *E21B 7/04* (2013.01); *E21B 7/06* (2013.01); *E21B 7/068* (2013.01); *E21B 7/10* (2013.01)

(58) Field of Classification Search
CPC ... E21B 7/04; E21B 7/06; E21B 7/067; E21B 7/068; E21B 7/10; E21B 4/02
See application file for complete search history.

(56) References Cited

U.S. PATENT DOCUMENTS

| | | | | |
|---|---|---|---|---|
| 4,991,668 | A | 2/1991 | Rehm et al. | |
| 5,439,064 | A | 8/1995 | Patton | |
| 8,210,283 | B1 | 7/2012 | Benson et al. | |
| 8,757,294 | B2 | 6/2014 | Johnson et al. | |
| 10,337,250 | B2 * | 7/2019 | Turner | E21B 47/02 |
| 2016/0076361 | A1 * | 3/2016 | Wong | E21B 47/12 175/40 |
| 2016/0305230 | A1 | 10/2016 | Benson et al. | |

FOREIGN PATENT DOCUMENTS

| | | |
|---|---|---|
| WO | 2014182303 | 11/2014 |

OTHER PUBLICATIONS

PCT International Search Report and Written Opinion in International Appln. No. PCT/US2020/024613, dated Jul. 7, 2020, 13 pages.

* cited by examiner

*Primary Examiner* — Tara E Schimpf
(74) *Attorney, Agent, or Firm* — Fish & Richardson P.C.

(57) ABSTRACT

A sensor is configured to sense a deflection angle and to transmit a second signal representing the sensed deflection angle to a downhole control unit. The downhole control unit is configured receive signals from at least the sensor. An adjustable bent sub assembly is mechanically coupled to the power section. The adjustable bent sub assembly is configured to, while the downhole motor is in the wellbore, adjust the deflection angle to the desired deflection angle. A biasing mechanism is communicatively coupled to the downhole control unit and mechanically coupled to the adjustable bent sub assembly. The biasing mechanism is configured to, while the downhole motor is in the wellbore, actuate the adjustable bent sub assembly responsive to the downhole control unit. A locking mechanism is coupled to the adjustable bent sub assembly. The locking mechanism is configured to lock the desired deflection angle.

18 Claims, 5 Drawing Sheets

SELF-ADJUSTING DOWNHOLE MOTOR

TECHNICAL FIELD

This disclosure relates to downhole-type drivers, for example, mud motors.

BACKGROUND

Wellbores are drilled using drilling systems to recover trapped hydrocarbons (for example, oil, gas, a combination of them, or other hydrocarbons) in subsurface reservoirs. Drilling systems typically include a drill bit at a downhole end of a drill string. In some instances, a drill bit is rotated in the wellbore by a drive, for example, a mud motor. Mud motors that are used to drill straight or deviated wellbores (that is, directional drilling) use a bent housing, or adjustable kick-off (AKO). The AKO provides a selected drilling angle or "tilt" to the drill bit to drill deviated sections of wellbores.

SUMMARY

This disclosure describes technologies relating to steerable downhole motors.

An example implementation of the subject matter described within this disclosure is a steerable downhole motor with the following features. A power section is configured to rotate a downhole tool within a wellbore around a rotational axis of the power section. A first sensor is attached to the steerable motor. The first sensor is configured to sense an operating parameter and to transmit a first signal representing the sensed operating parameter to a downhole control unit. A second sensor is attached to the steerable motor. The second sensor is configured to sense a deflection angle and to transmit a second signal representing the sensed deflection angle to the downhole control unit. The downhole control unit is communicatively coupled to the first sensor and second sensor. The downhole control unit is configured receive signals from at least the first sensor or second sensor. An adjustable bent sub assembly is mechanically coupled to the power section. The adjustable bent sub assembly is configured to, while the downhole motor is in the wellbore, adjust the deflection angle to the desired deflection angle. A biasing mechanism is communicatively coupled to the downhole control unit and mechanically coupled to the adjustable bent sub assembly. The biasing mechanism is configured to, while the downhole motor is in the wellbore, actuate the adjustable bent sub assembly responsive to the downhole control unit. A locking mechanism is coupled to the adjustable bent sub assembly. The locking mechanism is configured to lock the desired deflection angle.

Aspects of the example implementation, which can be combined with the example implementation alone or in combination, include the following. A tool shaft is at least partially within the downhole motor. The shaft is configured to receive and retain a downhole tool.

The power section includes a fluid-driven rotor coupled to a drive shaft. The drive shaft is rotatably coupled to the tool shaft.

Aspects of the example implementation, which can be combined with the example implementation alone or in combination, include the following. The downhole motor is a positive displacement type.

Aspects of the example implementation, which can be combined with the example implementation alone or in combination, include the following. The downhole tool includes a drill bit.

Aspects of the example implementation, which can be combined with the example implementation alone or in combination, include the following. The downhole control unit includes a radio-frequency identification detector.

Aspects of the example implementation, which can be combined with the example implementation alone or in combination, include the following. The adjustable bent sub assembly can include an adjustable kick-off.

Aspects of the example implementation, which can be combined with the example implementation alone or in combination, include the following. The adjustable bent sub assembly includes a top adjustable bent housing. A bottom adjustable bent housing at a downhole end of the adjustable bent sub assembly, the bottom adjustable bent housing is configured to lock and unlock an orienting sleeve. The orienting sleeve is positioned between the top adjustable bent housing and the bottomed adjustable bent housing. The orienting sleeve is configured to adjust the deflection angle. Multiple J-slots are positioned between the top adjustable bent housing and the orienting sleeve. The J-slots are configured to set and retain deflection angle biases.

Aspects of the example implementation, which can be combined with the example implementation alone or in combination, include the following. The adjustable bent sub assembly is adjusted to a deflection angle with a range of zero to three degrees from the rotational axis of the power section.

Aspects of the example implementation, which can be combined with the example implementation alone or in combination, include the following. A surface control unit is communicatively coupled to the downhole control unit. The surface control unit receives confirmation that a set of commands have been successfully executed.

Aspects of the example implementation, which can be combined with the example implementation alone or in combination, include the following. The operating parameter is a pump pressure cycle.

Aspects of the example implementation, which can be combined with the example implementation alone or in combination, include the following. The operating parameter is a rotational speed of the downhole tool.

Aspects of the example implementation, which can be combined with the example implementation alone or in combination, include the following. The biasing mechanism includes multiple J-slots.

An example implementation of the subject matter described within this disclosure is a method with the following features. An operating parameter of a wellbore tool is measured by a first sensor while operating within a wellbore. A first signal representing the operating parameter is transmitted by the first sensor to a downhole control unit. A deflection angle is measured by a second sensor while operating within a wellbore. A second signal representing the deflection angle is transmitted by the second sensor to a downhole control unit. A desired deflection angle is determined based on the signals received from at least the first sensor or second sensor. A third signal representing the desired deflection angle is transmitted by the downhole control unit to a biasing mechanism. A deflection angle of an adjustable bent sub assembly is adjusted, by the biasing mechanism, to the desired deflection angle, while operating within the wellbore. The desired deflection angle is locked, by a locking mechanism, while operating within the wellbore.

Aspects of the example implementation, which can be combined with the example implementation alone or in combination, include the following. The desired deflection angle is determined by the downhole control unit.

Aspects of the example implementation, which can be combined with the example implementation alone or in combination, include the following. The operating parameter is a pump pressure cycle.

Aspects of the example implementation, which can be combined with the example implementation alone or in combination, include the following. The operating parameter is a rotational speed of the downhole tool.

Aspects of the example implementation, which can be combined with the example implementation alone or in combination, include the following. A surface control unit is communicatively coupled to the downhole control unit. The surface control unit receives confirmation that a set of commands have been successfully executed.

An example implementation of the subject matter described within this disclosure is a steerable drilling system with the following features. A steerable downhole motor includes a power section configured to rotate a downhole tool within a wellbore around a rotational axis of the power section. A first sensor is attached to the steerable motor. The first sensor is configured to sense an operating parameter and to transmit a first signal representing the sensed operating parameter to a downhole control unit. A second sensor is attached to the steerable motor. The second sensor configured to sense a deflection angle and to transmit a second signal representing the sensed deflection angle to the downhole control unit. A downhole control unit is communicatively coupled to the first sensor and second sensor. The downhole control unit is configured to determine a desired deflection angle based on the signal received from at least the first sensor or second sensor. An adjustable bent sub assembly is mechanically coupled to the power section. The adjustable bent sub assembly is configured to, while the downhole motor is in the wellbore, adjust the deflection angle to the desired deflection angle. A biasing mechanism is communicatively coupled to the downhole control unit and mechanically coupled to the adjustable bent sub assembly. The biasing mechanism is configured to, while the downhole motor is in the wellbore, actuate the adjustable bent sub assembly responsive to the downhole control unit. A locking mechanism is coupled to the adjustable bent sub assembly. The locking mechanism is configured to lock the desired deflection angle. A drill string is mechanically connecting an uphole end of the steerable downhole motor to a topside facility. A drill bit is rotatably coupled to a downhole end of the steerable downhole motor.

Particular implementations of the subject matter described in this disclosure can be implemented so as to realize one or more of the following advantages. The self-adjustable mud motor of this disclosure can reduce undesired tripping (or rig non-productive) time. That is, the mud motor can be adjusted downhole without pulling out of the wellbore. The mud motor can be used to drill a variety of well profiles to achieve improved dogleg capability due to the self-adjusting mechanism. By reducing trips in and out of a wellbore, the wear and tear of downhole tools is reduced. The subject matter described herein improves well delivery time and reduces rig daily spread rate. By adjusting the mud motor downhole, the likelihood of efficiently drilling through interbedded layers is increased. The efficiency of drilling through interbedded layers is also increased by achieving required dog-legs effectively for the various formation types (hard or soft), eliminating undesired bottom hole assembly trips, and reducing rig non-productive time. Aspects of the subject matter described within can also improve well delivery time and reduce equipment cost.

The details of one or more implementations of the subject matter described in this disclosure are set forth in the accompanying drawings and description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Mud motors are typically used to drill vertical sections of a wellbore, deviated sections of a wellbore, or a combination (that is, directional drilling). One issue in directional drilling is pulling the drilling system out of the wellbore every time a bend or deflection angle needs to be adjusted while drilling deviated wellbores. Such repeated surface adjustments result in non-productive time as the drilling system is tripped in and out of the wellbore. The repeated tripping also induces high stress, vibration, and wear on the mud motor components. Thus, the drilling efficiency is reduced. In addition, using a greater than necessary bend angle can result in over-gauge holes and increased wear of motor components.

The subject matter described in this disclosure relates to operating a mud motor in directional drilling without pulling the drilling system out of the wellbore to change the deflection angle. The mud motor includes a bent sub assembly that self-adjusts a downhole tool of the drilling system. A biasing mechanism performs the self-adjustment by actuating the bent sub assembly in response to a command by a downhole control unit. The downhole control unit is connected to one or more sensors that measures one or more operating parameters in addition to a deflection angle. The operating parameters can include various well conditions, subsurface formation data, and drilling direction and angle. The operating parameters provide input that aids in determining different drilling deflection angles for different sections of a wellbore.

Figure 1:
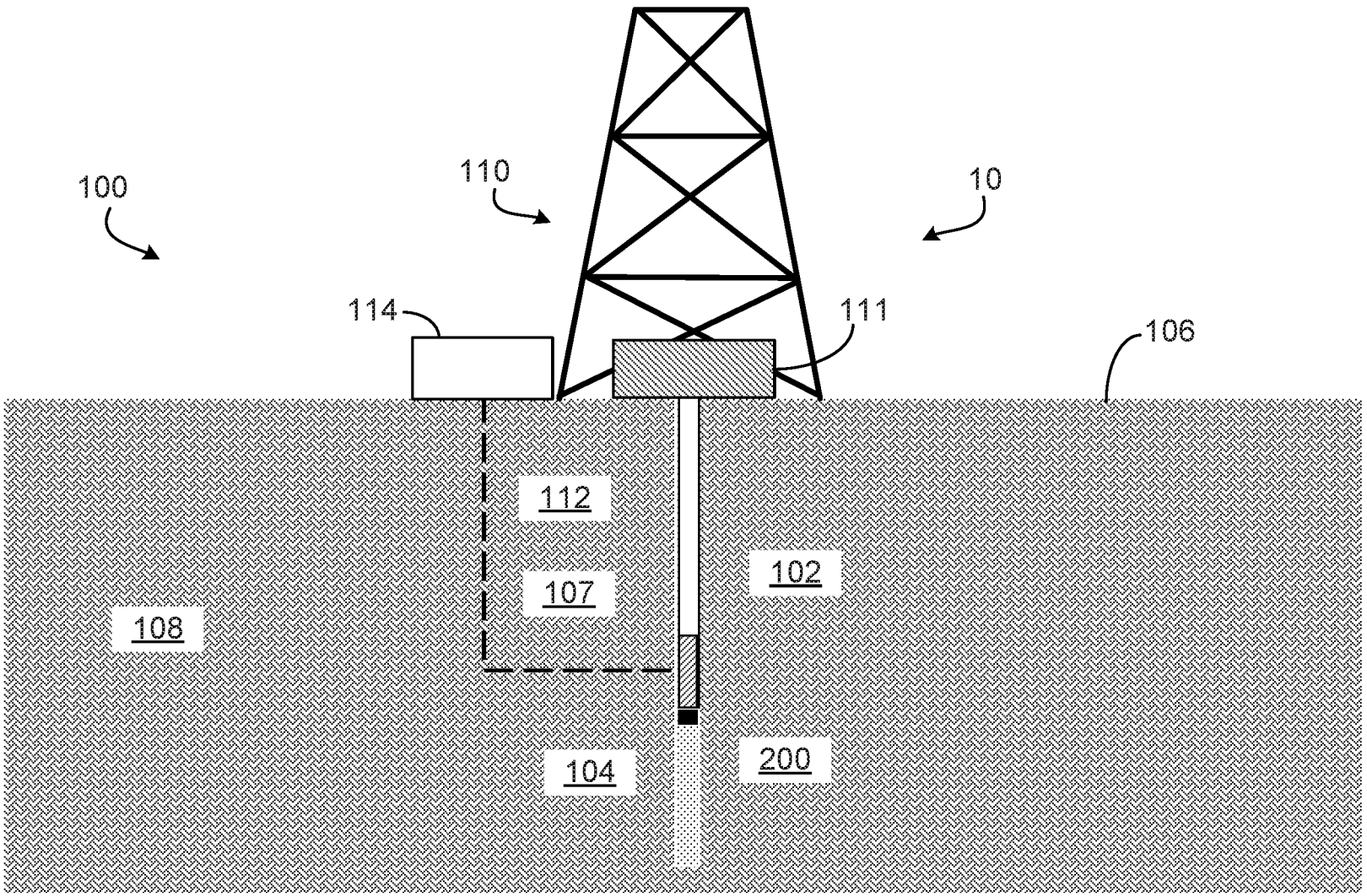
FIG. 1 is a side cross-sectional diagram of an example well system.

FIG. 1 is a side cross-sectional diagram of an example well system 100. The well system 100 includes a wellbore 107 that extends from surface 106 into the Earth 108. The well is shown as a vertical well, but in other instances, the well can be a deviated well with a wellbore 107 deviated from vertical (for example, horizontal or slanted). The wellbore 107 is typically, although not necessarily, cylindrical. In some implementations, all or a portion of the wellbore 107 is lined with a tubing, such a lining or a casing 112. The casing 112 extends from the surface 106 downhole into the wellbore 107. The casing 112 operates to isolate the wellbore 107 from the surrounding Earth 108. The casing 112 can be formed of a single continuous tubing or multiple lengths of tubing joined (for example, threadedly, welded, or both) end-to-end. In some cases, the wellbore 107 is uncased (for example, openhole).

The well system 100 of FIG. 1 shows a drilling system inside the wellbore 107. The drilling system includes a drill string 102. In some implementations, the drill string 102 is used to drill the wellbore 107. The drill string 102 is made of materials compatible with the wellbore geometry, well production requirements, and formation fluids. As shown in FIG. 1, the drill string 102 is coupled to a topside facility 10. The topside facility 10 includes a top drive 111. The top drive 111 is a device that applies torque to turn the drill string 102. In some implementations, the top drive 111 can include one or more hydraulic or electric motors. In some implementations, a rotary table and kelly drive can be used instead of the top drive 111. The topside facility includes a derrick 110. The derrick 110 is a structure that is used to support the drill string 102 inside the wellbore 107. In some implementations, the derrick 110 is pyramidal in shape. While illustrated and being used in conjunction with a drill rig with a derrick 110, the subject matter described herein can similarly be applied to coiled tubing drilling operations without departing from this disclosure. In such an implementation, a top drive might not be used.

The drilling system includes a downhole motor 200. The downhole motor 200 is of a type configured in size to be inserted into the wellbore 107. The downhole motor 200 is robust in construction to withstand the harsh downhole environment of the wellbore 107 (for example, high temperature, high pressure, a corrosive environment, or a combination). The downhole motor 200 is configured to attach to the drill string 102. In some implementations, the downhole motor 200 (also referred to as mud motor) is attached to a downhole end of the drill string 102. In some implementations, the downhole motor 200 is nearer a downhole end of the drill string 102 than an uphole end of the drill string 102. In some implementations, the downhole motor 200 is a positive displacement mud motor. In some implementations, the downhole motor 200 is a hydraulic drilling motor that is powered by a drilling fluid (also referred to as drilling mud) to rotate a downhole tool 104. Alternatively, the downhole motor 200 can include any other device that can rotate the downhole tool 104, such as an electric motor.

The drilling system includes a downhole tool 104. In some implementations, the downhole tool 104 is rotatably coupled to a downhole end of the downhole motor 200. The downhole tool 104 is a device that drills or crushes rock formations into the Earth 108 by applying, for example, rotational motion, axial pressure, or both. Typically, the rotational motion is supplied at least in part by a mud motor. The downhole tool 104 is of a type configured in size, to be inserted into the wellbore 107, and robust construction, to withstand the impact of drilling hard rock formations. In some implementations, the downhole tool 104 is a drill bit. Alternatively, the downhole tool 104 can include any other tool that can crush rock formations.

Figure 2:
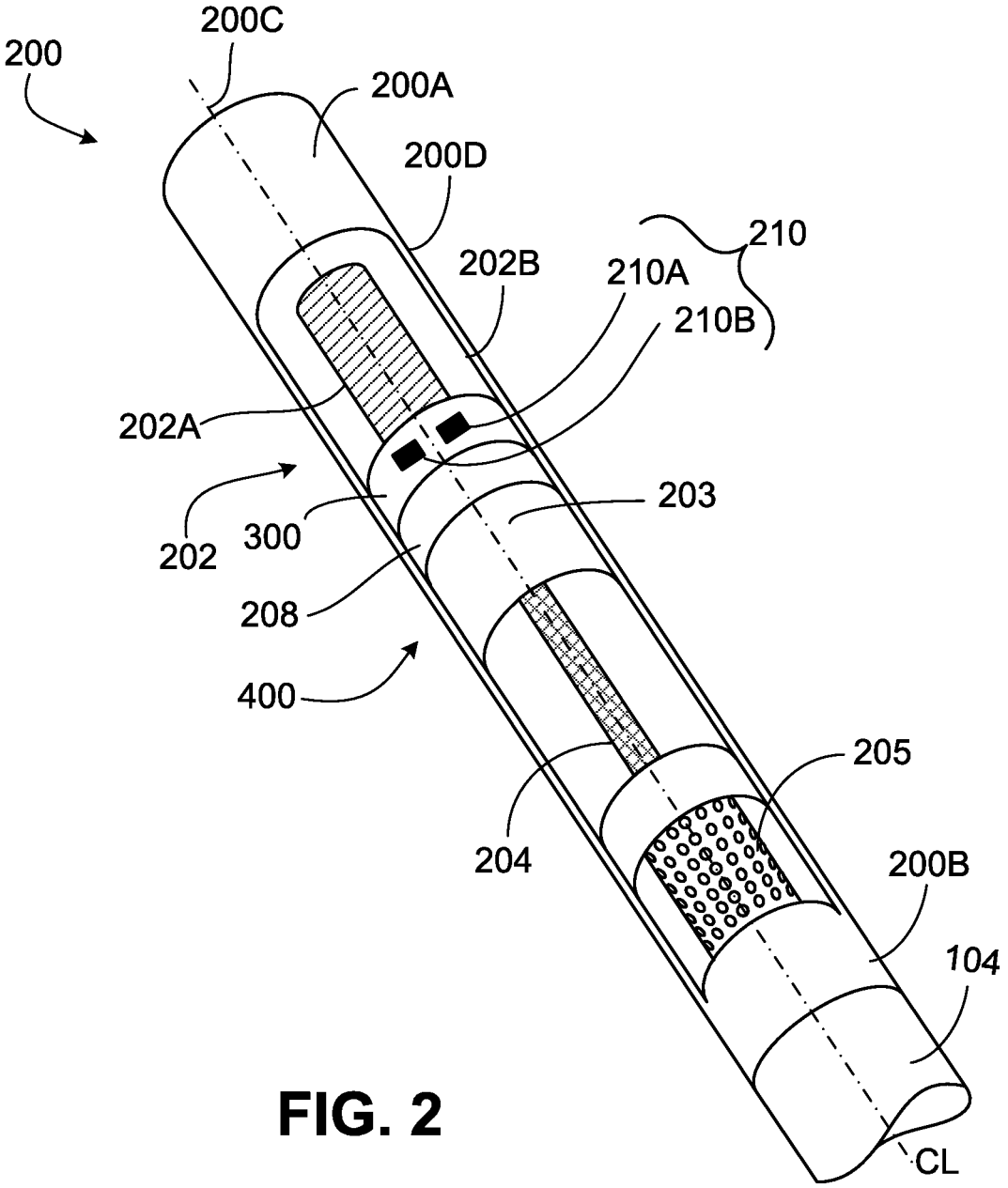
FIG. 2 is a side cross-sectional diagram of an example steerable downhole motor of this disclosure.

FIG. 2 shows a cross-sectional diagram of an example steerable downhole motor 200. As previously described, the downhole motor 200 is used to rotate the downhole tool 104 in order to drill a wellbore. The downhole motor 200 includes a top sub 200A. The top sub 200A is positioned at an uphole end of the downhole motor 200 and connects the downhole motor 200 to the drill string 102. The downhole motor 200 includes a bottom sub 200B. The bottom sub 200B is positioned at a downhole end of the downhole motor 200 and connects the downhole motor 200 to the downhole tool 104. The downhole motor 200 has a rotational axis 200C that passes through the top sub 200A and the bottom sub 200B.

The downhole motor 200 includes a power section 202. The power section 202 is configured to rotate the downhole tool 104 within the wellbore 107 around the rotational axis 200C. The power section 202 includes a fluid-driven rotor 202A. The rotor 202A rotates the downhole tool 104 in response to a drilling fluid circulating through the power section 202. In some implementations, the rotor 202A is made of metal. The power section 202 includes a stator 202B. The stator 202B surrounds the rotor 202A. In some implementations, the stator 202B is made from a molded elastomer. The stator 202B includes two or more lobes. The rotor 202A is positioned within the stator 202B and has one less gear or lobe than the stator 202B. Because of this difference between the number of lobes in the rotor 202A and stator 202B, a cavity is created which is filled with drilling fluid that hydraulically powers the downhole motor 200 to rotate in the wellbore 107. The stator 202B is surrounded by a housing 200D. In some implementations, the housing 200D is a metal casing that protects internal components of the downhole motor 200. While a single power section 202 configuration has been described, other configurations, for example, using an electric motor or other hydraulic pump arrangement, can be used without departing from this disclosure.

The downhole motor 200 includes a drive shaft 203. The drive shaft 203 is rotatably coupled to the rotor 202A. The drive shaft 203 (also referred to as a transmission section) transmits an eccentric power generated by the rotor 202A into concentric power to a tool shaft 204. The tool shaft 204 is rotatably coupled to the drive shaft 203. The tool shaft 204 is configured to receive and retain the downhole tool 104. The downhole tool 104 can be attached to the tool shaft 204 using a variety of fastening methods, for example, by welding, interference fit, or threaded connection. In some implementations, the tool shaft 204 is at least partially within the downhole motor 200.

The downhole motor 200 includes a bearing assembly 205. The bearing assembly 205 is positioned between the power section 202 and the downhole tool 104. The bearing assembly 205 can include one or more radial bearings, one or more thrust bearings, or a combination. In some implementations, the bearing assembly 205 radially supports the tool shaft 204. In some implementations, the bearing assembly 205 axially supports the tool shaft 204. In some implementations, the bearing assembly 205 radially supports the drive shaft 203. In some implementations, the bearing assembly 205 axially supports the drive shaft 203. In some implementations, the bearing assembly 205 includes sealed bearings, for example, oil sealed bearings. In some implementations, the bearing assembly 205 includes unsealed bearings, for example, drilling mud lubricated bearings. In some implementations, ball bearings can be used. Such an implementation can include bearings sealed in a slick or integral blade-type stabilizer. The sealant can be oil-sealed or mud lubricated.

The downhole motor 200 includes one or more sensors. A control unit 300 can include sensors and controllers to read and receive instructions from RFID chips that can be carried by the circulation fluid. The control unit 300 can be positioned uphole of the mechanical actuation system 208, and integrated as part of the downhole motor 200. A circulated RFID chip (or chips) is encoded with specific instructions, such as changing a bend angle. The control unit 300 downhole receives and decodes these instructions. The control unit 300 then sends instructions to the adjustable bent housing sub 400, and the mechanical actuation system adjusts to the desired bent housing sub assembly angle in response to receiving the instructions. In some implementations, adjustments can be made using string rotation, flow rate change, or through battery powered downhole actuators. The downhole RFID device can also include one or more piezo-crystal transducers that detect pressure pulses (if flow rate is used), or string torque (if string RPM is used). Information can be transmitted to surface, and also decoded to confirm the action has been executed downhole. For example, a signal representing the sensed operating parameter, such as flowrate or rotation speed, can be sent to a topside facility. Other sensors measuring other parameters can be included in the control unit 300. In some implementations, an integrated sensor that can decode radio frequency instructions, or identify significant changes in flow rate, string rotation, or a combination of these parameters. After the desired bent housing sub assembly angle is achieved, the control unit 300 is configured to sense a deflection angle and to transmit a signal representing the sensed deflection angle to the topside facility. In some implementations, sensors that can detect downhole drilling mechanical parameters such as downhole torque, downhole weight-on-bit, downhole vibrations, and stick-and-slip severity measurements, can be installed elsewhere on the string, such as on the bit box.

In operation, the desired deflection angle is subject to calculations done by a directional drilling "DD" engineer at surface. The engineer has to determine that a greater (or lesser) deflection angle is required to achieve a specific sub-surface target. Once that determination is made, the engineer can then send commands to the downhole motor 200 to effect changes to the bent housing sub assembly angle in hole. Because the "J-Slots" 406 (FIG. 4) correspond to bent housing sub assembly angle settings, the control unit 300 will have a feedback system to know which J-Slot 406 has been engaged. Once the correct J-Slot 406 is engaged, the RFID device transmits that information to the topside facility 10 via generated pressure pulses (which would require to be decoded at surface).

Alternatively or in additions, other communication modes can be used. Such communication modes can be used for sending down-hole tool commands and receiving confirmation that a bent housing sub assembly angle adjustment has been made. For example, a "Low Tool Bus" or LTB communication protocol can be used between the Smart Adjustable Positive Displacement Mud Motor and a MWD tool. Commands can be sent via this LTB connection between the motor and MWD, and communication can be confirmed using the currently existing MWD surface panels in the MWD unit. In some implementations, communication can be via wired drill pipes. In some implementations, radio waves can be sent to the surface to communicate which J-slot 406 has been engaged.

The downhole motor 200 includes a downhole control unit 300. The downhole control unit 300 is communicatively coupled to the first sensor 210*a* and second sensor 210*b*. In some implementations, the downhole control unit 300 is positioned between the power section 202 and the bearing assembly 205. The downhole control unit 300 is configured to determine a desired deflection angle based on the signals received from at least the first sensor 210*a* or second sensor 210*b*. In some implementations, calculations to determine the bend angle are calculated and executed by the control unit 300. In some implementations, no calculations are done by the control unit. Instead, the DD engineer establishes that a bent housing sub assembly angle adjustment is required. Instructions are then sent to the control unit 300 to make the adjustments as per the physical embedded design of the smart adjustable bent housing assembly 400.

The downhole motor 200 includes an adjustable bent sub assembly 400. The bent sub assembly 400 is coupled to the biasing mechanism, also known as the mechanical drive system. The adjustable bent sub assembly 400 has predetermined setting positions. The rotational position or settings can be adjusted without pulling the string back to surface. In some implementations, the downhole control unit 300 is part of an "adjustable assembly" that includes the control unit 300, mechanical actuation system 208, and the adjustable bent housing sub assembly 400 stacked in that order from an uphole end to a downhole end. In some implementations, the control unit 300 can be completely or partially at the topside facility. If all or partially downhole, the control unit 300 communicates with the topside facility that an adjustment has been made. In some implementations, the control unit 300 is a part of the biasing mechanism 500. In some implementations, the bent sub assembly 400 is positioned between the power section 202 and the bearing assembly. The bent sub assembly 400 is configured to adjust the deflection angle of the downhole tool 104 to the desired deflection angle. The bent sub assembly 400 adjusts the deflection angle while the downhole motor 200 is inside the wellbore 107.

Figure 3:
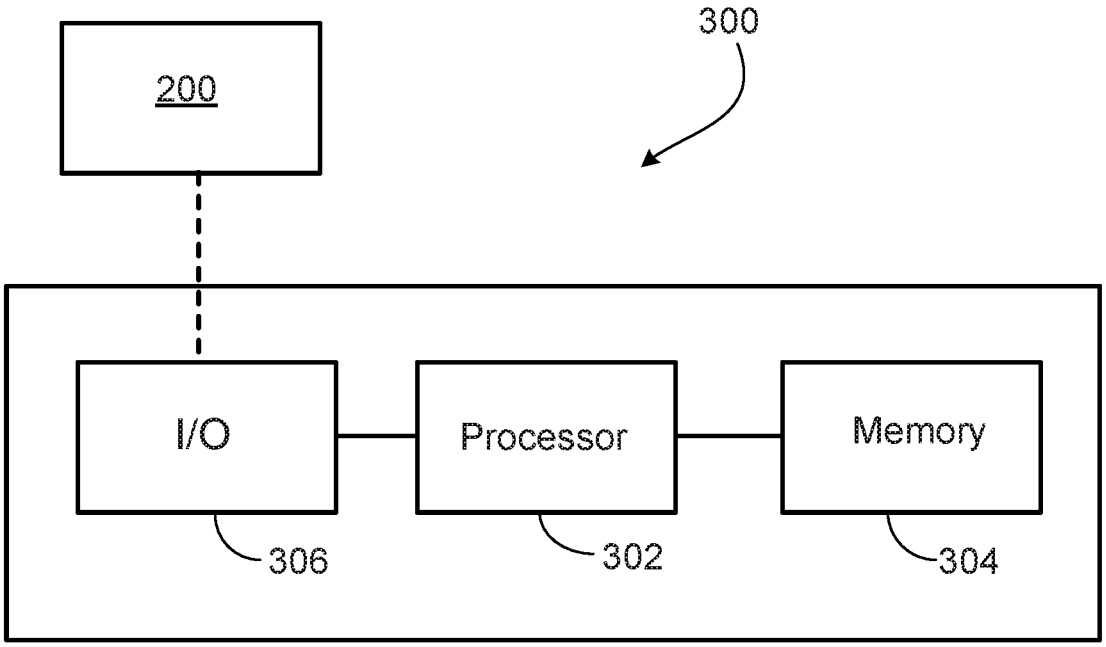
FIG. 3 is a block diagram of an example downhole control unit that can be used with aspects of this disclosure.

FIG. 3 is a block diagram of the downhole control unit 300. The downhole control unit 300, among other things, monitors rotational speed of the downhole motor 200, monitors the inclination angle, and monitors the rate of penetration. The control unit 300 communicates with the mechanical drive system, such as the top drive 111, the power section 202, or other actuable components, and controls angle adjustment of the bent housing sub assembly 400. A signal indicating the bent housing sub assembly angle adjustment is sent to the topside facility 10. In some implementations, the control unit 300 can communicate with the MWD tool via a LTB protocol or via wire drill pipes. As shown in FIG. 3, the control unit 300 includes one or more processors 302 and non-transitory storage media (e.g., memory 304) containing instructions that cause the processors 302 to perform the methods described herein. The processors 302 are coupled to an input/output (I/O) interface 306 for sending and receiving communications with other equipment within the well or at the topside facility, including, for example, the adjustable bent sub assembly 400. In certain instances, the control unit 300 can additionally communicate the status with, and send actuation and control signals to any actuable devices on the drill string 102. In certain instances, the control unit 300 can communicate the status and send actuation and control signals to one or more of the systems on the well site, including downhole torque, weight-on-bit, vibrations, stick-and-slip. The communications can be hardwired, wireless or a combination of wired and wireless. In some implementations, the control unit 300 can be located on the downhole motor 200. In some implementations, the control unit 300 can be located elsewhere, such as at the topside facility, or even remotely from the topside facility. In some implementations, the control unit 300 can be a distributed controller with different portions located about the well site or off site. For example, in certain instances, a portion of the control unit 300 can be located at the downhole motor 200, while another portion of the control unit 300 can be located at the topside facility.

The control unit 300 can operate in monitoring, controlling, and using the motor downhole 200 for adjusting the drill path via the adjustable bent sub assembly 400 (described later). To monitor and control the downhole motor 200, the control unit 300 is used in conjunction with transducers (sensors) to measure the pressure of fluid at various positions in the drill string 102 and to measure the position of various parts of the motor 200. Input and output signals, including the data from the transducers, controlled and monitored by the control unit 300, can be logged continuously by the control unit 300. The logged data can be stored on the control unit 300, at a remote location, or both.

In some implementations, the control unit 300 includes a radio-frequency identification detector (RFID). In some implementations, the downhole control unit 300 is communicatively coupled to a surface control unit 114. Various tasks can be split between the surface control unit 114 and the downhole control unit 300. For example, the surface control unit 114 can receive confirmation that a set of commands have been successfully executed.

Figure 4:
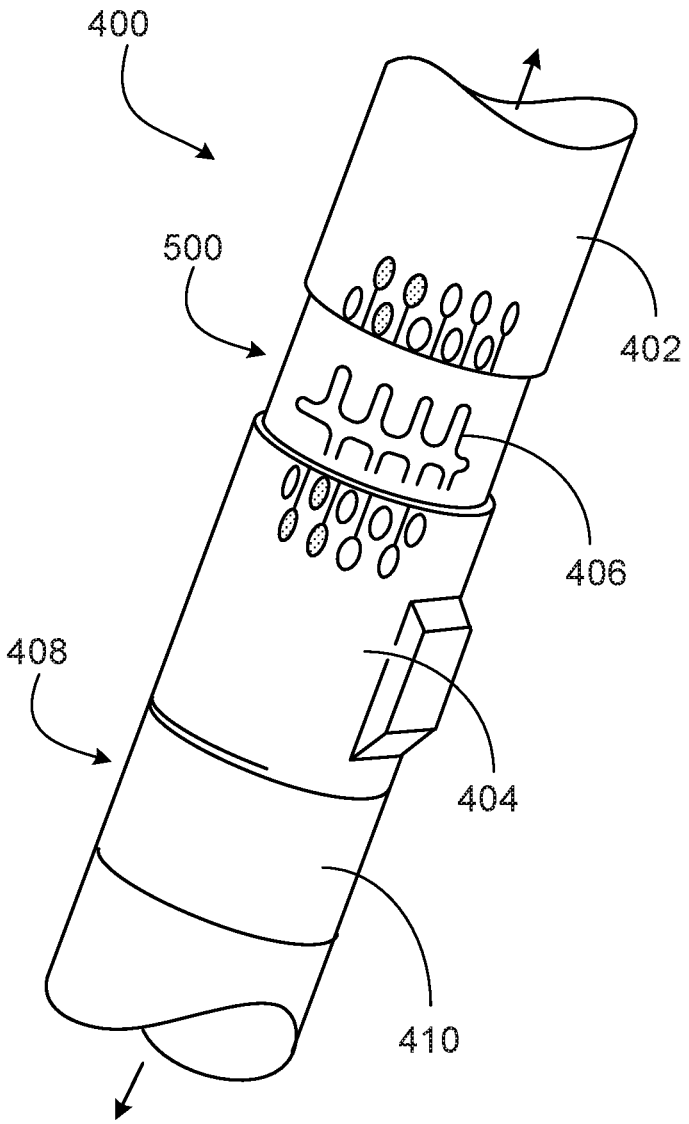
FIG. 4 is a side cross-sectional diagram of an example adjustable bent sub assembly, biasing mechanism, and locking mechanism of this disclosure.

FIG. 4 is a side cross-sectional diagram of an example adjustable bent sub assembly 400, biasing mechanism 500, and locking mechanism 408. At an uphole end of the adjustable bent sub assembly 400 is the top adjustable bent housing 402. The top adjustable bent housing 402 can be rotated to engage threads and create a gap between the top adjustable bent housing 402 and the orienting/adjusting sleeve 404 positioned at a downhole end of the adjustable bent housing assembly 400. The orienting sleeve 404 is then turned or adjusted to the required bend angle defined by a biasing mechanism 500, such as the J-Slots 406, and engaged in place. The locking mechanism 408, in this case, the bottom adjustable bent housing 410, is then rotated, engaging threads, to hold the orienting sleeve 404 in its new position, and locked in place accordingly. As illustrated, the locking mechanism includes J-Slots 406 and the bottom adjustable bent housing 410. The illustrated implementation includes eight J-Slots 406, but greater or fewer J-Slots 406 can be used without departing from this disclosure. Each J-Slot 406 can change an inclination angle from 0.3-0.4 degrees per slot, providing an inclination range of zero to three degrees. In some implementations, greater inclination angles can be achieved. In some implementations, different inclination angle changes between each J-slot can be used.

The downhole motor 200 includes a biasing mechanism 500. The biasing mechanism 500 is communicatively coupled to the downhole control unit 300. The biasing mechanism 500 is mechanically coupled to the bent sub assembly 400. In some implementations, the biasing mechanism 500 is positioned between the power section 202 and the bent sub assembly 400. The biasing mechanism 500 is configured to actuate the bent sub assembly 400 in response to the downhole control unit 300. While the downhole motor 200 is inside the wellbore 107, the downhole control unit 300 communicates the desired deflection angle to the biasing mechanism 500. The biasing mechanism 500 actuates the bent sub assembly 400, which, in turn, performs the adjustment. In some implementations, the control unit 300, the bent sub assembly 400, and the biasing mechanism 500 can be electrically powered, for example, with lithium based batteries. In such an implementation, a small turbine and generator can be include to recharge the batteries via mud flow. In some implementations, components may be hydraulically powered. For example, the control unit can actuate downhole valves to make adjustments to the bent sub assembly 400, the biasing mechanism 500, or both.

Figure 5:
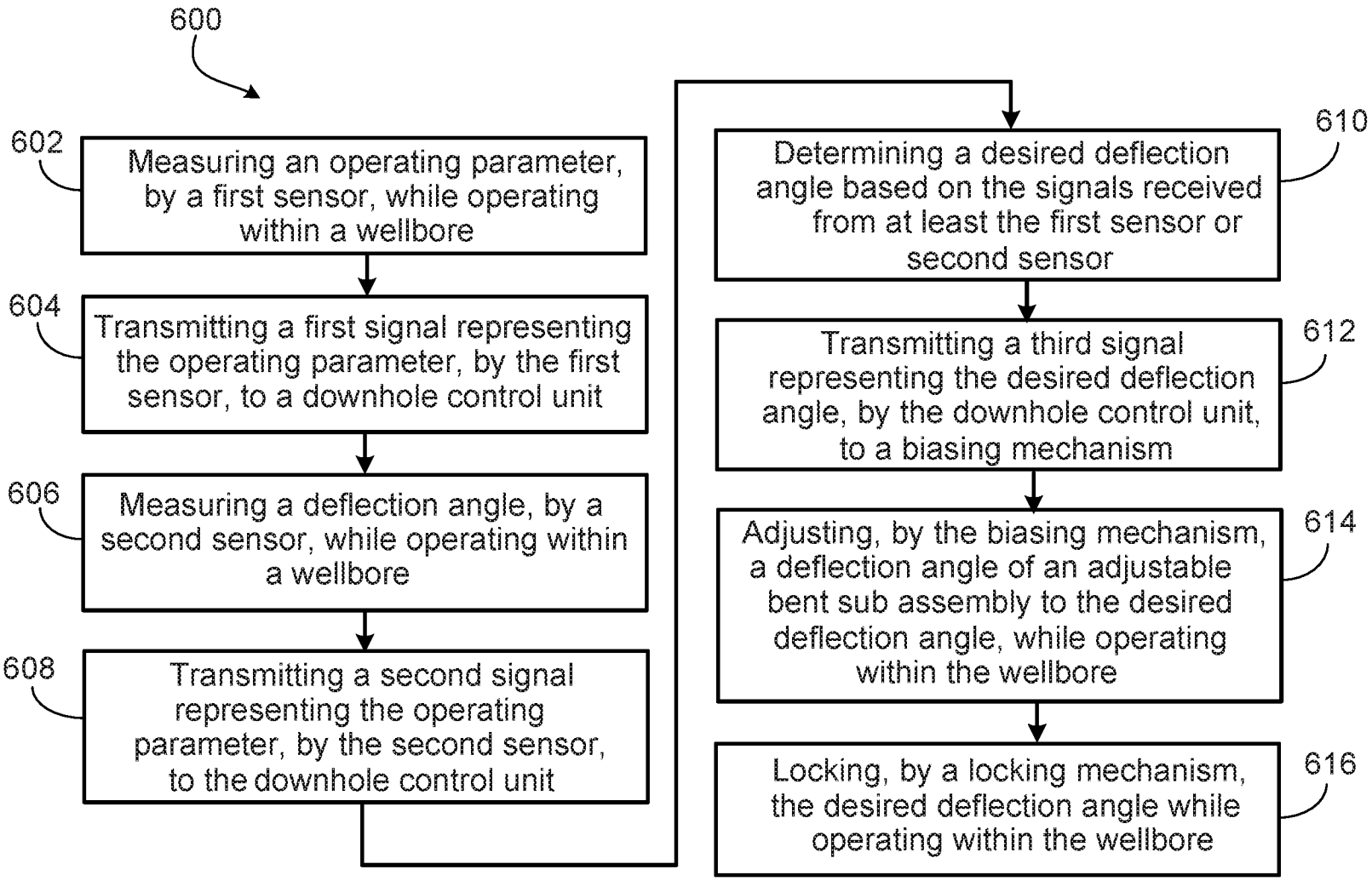
FIG. 5 is a flowchart of an example method that can be used with aspects of this disclosure.

FIG. 5 shows a flowchart of an example method 600 that can be used with aspects of this disclosure. Details of this method 600 are described in context of FIGS. 1-5. Upon starting the steerable drilling system, the downhole motor 200 is rotating inside a wellbore 107 in response to drilling fluid circulating through a power section 202 of the downhole motor 200.

At 602, a first sensor 210*a* measures an operating parameter while the downhole motor 200 is operating within the wellbore 107.

At 604, the first sensor 210*a* transmits a first signal representing the operating parameter to a downhole control unit 300. In some implementations, the operating parameter is rotational speed of the downhole tool 104. At 606, a second sensor 210*b* measures a deflection angle of a downhole tool 104 while the downhole motor 200 is operating within the wellbore 107. At 608, the second sensor 210*b* transmits a second signal representing the deflection angle to the downhole control unit 300. At 610, a desired deflection angle is determined based on the signals received from at least the first sensor or second sensor. The desired deflection angle can be determined by a drilling engineer or the controller.

At 612, the downhole control unit 300 transmits a third signal representing the desired deflection angle to a biasing mechanism 500. In some implementations, the operating parameter is a pump pressure cycle of the downhole motor 200. To receive commands, the control unit 300 can be configured to switch to "listening" mode after detecting a range of certain pressure pulses caused by several high/low flow rates, and for a defined "continuous" period of time, for a number of cycles. Prior to initiating the "listening" mode, rotation of the string is ceased. The control unit 300 can also be configured to go into "listening" mode if it detects the drill string rotation at a certain threshold, and for a defined "continuous" period of time, for a number of cycles. For example, variations caused by 50 GPM, sustained for a 1-minute duration, and repeated in 5 cycles. The control unit 300 can stay in "listening" mode for a period of time, for example, five minutes. Shorter or longer periods of time can be used depending on the application. For example, longer "listening" mode periods can be used for deep well applications. Once in listening mode, RFID tags can be circulated to pass commands to the control unit 300. The RFID tag can be an active tag (with an on-board battery) that periodically transmits, or the RFID tag can be battery-assisted passive (where it is activated only in the presence of an RFID reader chip). Within a minute of fully executing the received command, the control unit 300 can send confirmation to the surface, for example, via a pressure pulse or via MWD LTB protocol. In some implementations, commands can be sent to the control unit 300 with changes in flow rates or with mud pulses. For example, a series of high/low flow rates correspond to a "deflection angle step", with perhaps another sequence in between as a "pause" between commands.

At 614, the biasing mechanism 500 adjusts a deflection angle of an adjustable bent sub assembly 400 to the desired deflection angle, while the downhole motor 200 is operating within the wellbore 107.

At 616, a locking mechanism locks the desired deflection angle while the downhole motor 200 is operating within the wellbore 107.

In some implementations, the downhole control unit 300 is communicatively coupled to a surface control unit 114 (FIG. 1). The surface control unit 114 receives and displays confirmation information that a set of instructions has been executed by the control unit 300. In some implementations, the surface control unit can receive and display other downhole information, such as downhole torque, weight-on-bit, vibrations, and any other relevant downhole information.

In some implementations, for vertical wells, the adjustable bent sub assembly 400 is adjusted to a zero-degree deflection angle, from the rotational axis 200C of the downhole motor 200, at surface. In some implementations, for deviated wells (or wells where directional drilling is used), the adjustable bent sub assembly 400 is adjusted to a deflection angle with a range of zero to three degrees, from the rotational axis 200C of the downhole motor 200, at surface.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A steerable downhole motor comprising:

a power section configured to rotate a downhole tool within a wellbore around a rotational axis of the power section;

a first sensor attached to the steerable downhole motor, the first sensor configured to sense an operating parameter and to transmit a first signal representing the sensed operating parameter to a downhole control unit;

a second sensor attached to the steerable downhole motor, the second sensor configured to sense a deflection angle and to transmit a second signal representing the sensed deflection angle to the downhole control unit;

the downhole control unit communicatively coupled to the first sensor and second sensor, the downhole control unit configured receive signals from at least the first sensor or second sensor;

an adjustable bent sub assembly mechanically coupled to the power section, the adjustable bent sub assembly configured to, while the downhole motor is in the wellbore, adjust the deflection angle to a desired deflection angle;

a biasing mechanism communicatively coupled to the downhole control unit and mechanically coupled to the adjustable bent sub assembly, the biasing mechanism configured to, while the downhole motor is in the wellbore, actuate the adjustable bent sub assembly responsive to the downhole control unit, wherein the biasing mechanism comprises a plurality of J-slots; and a locking mechanism coupled to the adjustable bent sub assembly, the locking mechanism configured to lock the desired deflection angle.

2. The downhole motor of claim 1, further comprising a tool shaft at least partially within the downhole motor, the shaft configured to receive and retain the downhole tool.

3. The downhole motor of claim 2, wherein the power section comprises a fluid-driven rotor coupled to a drive shaft, the drive shaft rotatably coupled to the tool shaft.

4. The downhole motor of claim 3, wherein the power section is a positive displacement type.

5. The downhole motor of claim 1, wherein the downhole tool comprises a drill bit.

6. The downhole motor of claim 1, wherein the downhole control unit comprises a radio-frequency identification detector.

7. The downhole motor of claim 1, wherein the adjustable bent sub assembly is an adjustable kick-off.

8. The downhole motor of claim 1, wherein the adjustable bent sub assembly comprises:

a top adjustable bent housing;

a bottom adjustable bent housing at a downhole end of the adjustable bent sub assembly, the bottom adjustable bent housing configured to lock and unlock an orienting sleeve;

the orienting sleeve positioned between the top adjustable bent housing and the bottom adjustable bent housing, the orienting sleeve configured to adjust the deflection angle; and a plurality of J-slots positioned between the top adjustable bent housing and the orienting sleeve, the J-slots configured to set and retain discreet deflection angle biases.

9. The downhole motor of claim 1, wherein the adjustable bent sub assembly is adjusted to the deflection angle with a range of zero to three degrees from the rotational axis of the power section.

10. The downhole motor of claim 1, further comprising a surface control unit communicatively coupled to the downhole control unit, the surface control unit receiving confirmation that a set of commands have been successfully executed.

11. The downhole motor of claim 1, wherein the operating parameter is a pump pressure cycle.

12. The downhole motor of claim 1, wherein the operating parameter is a rotational speed of the downhole tool.

13. A method comprising:

measuring an operating parameter of a wellbore tool, by a first sensor, while operating within a wellbore;

transmitting a first signal representing the operating parameter, by the first sensor, to a downhole control unit;

measuring a deflection angle, by a second sensor, while operating within a wellbore;

transmitting a second signal representing the deflection angle, by the second sensor, to a downhole control unit;

determining a desired deflection angle based on the signals received from at least the first sensor or second sensor;

transmitting a third signal representing the desired deflection angle, by the downhole control unit, to a biasing mechanism;

adjusting, by the biasing mechanism comprising a plurality of J-slots, a deflection angle of an adjustable bent sub assembly to the desired deflection angle, while operating within the wellbore; and locking, by a locking mechanism, the desired deflection angle while operating within the wellbore.

14. The method of claim 13, wherein the desired deflection angle is determined by the downhole control unit.

15. The method of claim 13, wherein the operating parameter is a pump pressure cycle.

16. The method of claim 13, wherein the operating parameter is rotational speed of the wellbore tool.

17. The method of claim 13, further comprising a surface control unit communicatively coupled to the downhole control unit, the surface control unit receiving confirmation that a set of commands have been successfully executed.

18. A steerable drilling system comprising:

a steerable downhole motor comprising:

a power section configured to rotate a downhole tool within a wellbore around a rotational axis of the power section;

a first sensor attached to the steerable downhole motor, the first sensor configured to sense an operating parameter and to transmit a signal representing the sensed operating parameter to a downhole control unit;

a second sensor attached to the downhole steerable motor, the second sensor configured to sense a deflection angle and to transmit a signal representing the sensed deflection angle to the downhole control unit;

a downhole control unit communicatively coupled to the first sensor and second sensor, the downhole control unit configured to determine a desired deflection angle based on the signal received from at least the first sensor or second sensor;

an adjustable bent sub assembly mechanically coupled to the power section, the adjustable bent sub assembly configured to, while the downhole motor is in the wellbore, adjust the deflection angle to the desired deflection angle;

a biasing mechanism communicatively coupled to the downhole control unit and mechanically coupled to the adjustable bent sub assembly, the biasing mechanism configured to, while the downhole motor is in the wellbore, actuate the adjustable bent sub assembly responsive to the downhole control unit, wherein the biasing mechanism comprises a plurality of J-slots;

a locking mechanism coupled to the adjustable bent sub assembly, the locking mechanism configured to lock the desired deflection angle;

a drill string mechanically connecting an uphole end of the steerable downhole motor to a topside facility; and a drill bit rotatably coupled to a downhole end of the steerable downhole motor.

* * * * *